US005682756A

United States Patent [19]

Lehmiller et al.

[11] Patent Number: 5,682,756

[45] Date of Patent: Nov. 4, 1997

[54] APPARATUS AND METHOD FOR CONTROLLING THE OPERATION OF A REFRIGERATION SYSTEM

[76] Inventors: Robert G. Lehmiller, 201 W. 1900 South, Clearfield; David K. Jacks, 1211 S. Via La Costa Way, Kaysville, both of Utah 84015

[21] Appl. No.: 668,217

[22] Filed: Jun. 21, 1996

[51] Int. Cl.[6] ..... F25B 49/02

[52] U.S. Cl. ..... 62/157; 62/163; 62/231

[58] Field of Search ..... 62/157, 158, 231, 62/161, 163, 298, 303, 234, 155

[56] References Cited

U.S. PATENT DOCUMENTS

| | | | |
|---|---|---|---|
| 3,643,459 | 2/1972 | Matthies | 62/157 |
| 3,762,178 | 10/1973 | Yamada et al. | 62/157 |
| 4,027,171 | 5/1977 | Browder et al. | 62/231 X |
| 4,132,085 | 1/1979 | Maio et al. | 62/155 |
| 4,235,181 | 11/1980 | Stickney | 114/211 |
| 4,358,932 | 11/1982 | Helfrich, Jr. | 62/126 |
| 4,481,785 | 11/1984 | Tershak et al. | 62/153 |
| 4,566,285 | 1/1986 | Tershak et al. | 62/129 |
| 4,799,362 | 1/1989 | Chestnut | 62/298 X |
| 4,850,198 | 7/1989 | Helt et al. | 62/93 |
| 4,938,027 | 7/1990 | Midlang | 62/161 X |
| 5,369,962 | 12/1994 | Szynal et al. | 62/298 |

*Primary Examiner*—Harry B. Tanner

*Attorney, Agent, or Firm*—Meschkow & Gresham, P.L.C.

[57] ABSTRACT

An apparatus for controlling the operation of a refrigeration system having a compressor, a defrost timer that provides an operating power supply, a solenoid valve, and a thermostat includes a relay switch and a delay timer. The relay switch is coupled in series between the defrost timer and the thermostat, and it is configured to electrically disconnect an operating power supply from the thermostat for a predetermined time period regulated by the delay timer. The solenoid valve closes when the relay switch is in the opened state and the compressor remains functional during the predetermined time period.

18 Claims, 2 Drawing Sheets

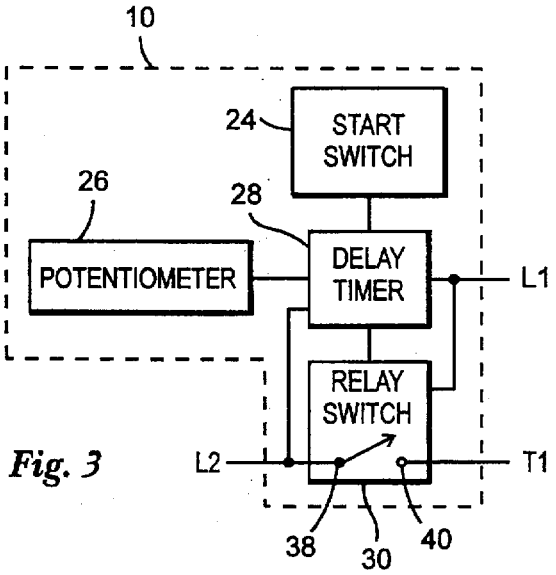
*Fig. 3*
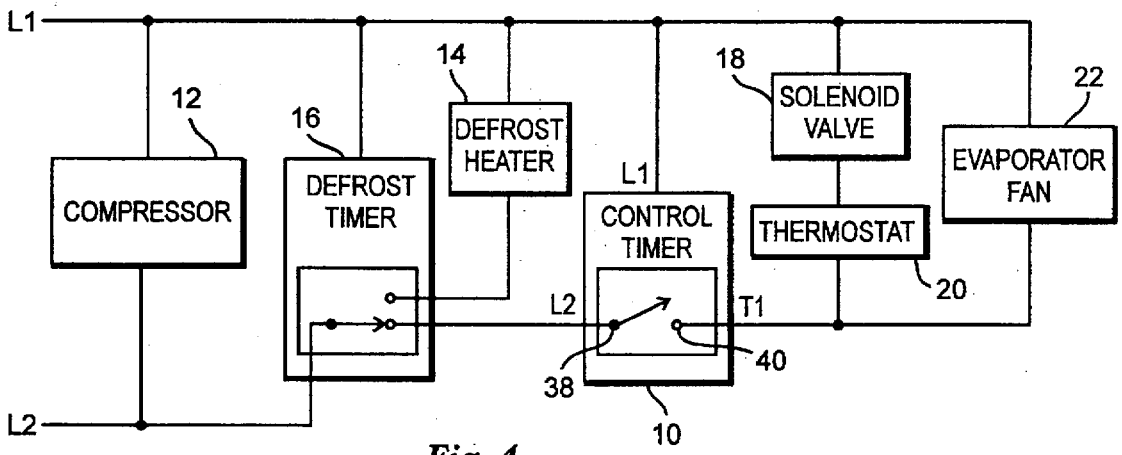
*Fig. 4*
*Fig. 5*
| DEFROST TIMER MODE | CONTROL TIMER RELAY | DEFROST HEATER | T1 |
|---|---|---|---|
| ACTIVE | CLOSED | OFF | POWERED |
| ACTIVE | OPENED | OFF | DISABLED |
| DEFROST | CLOSED | ON | DISABLED |
| DEFROST | OPENED | ON | DISABLED |

APPARATUS AND METHOD FOR CONTROLLING THE OPERATION OF A REFRIGERATION SYSTEM

BACKGROUND OF THE INVENTION

1. Field of the Invention

The present invention relates to control devices for refrigeration systems. More specifically, the present invention relates to control devices for refrigeration systems known as freezers. In a still more specific aspect, the present invention relates to control devices for commercial walk-in freezers.

2. The Prior Art

Refrigeration systems and their operating modes are well known in the prior art. Such systems are typically utilized in household refrigerators, automotive air conditioner systems, and commercial freezer applications. Walk-in refrigerators and freezers are often used in restaurants, grocery stores, warehouses, and the like.

Workers are often required to perform daily tasks related to the maintenance of a commercial walk-in freezer or the items stored in the freezer. For example, the freezer compartment may have to be periodically cleaned, food or merchandise may have to be counted for inventory purposes, and food or merchandise may have to be added to, removed from, or rearranged within the freezer. In many instances, these chores can take a substantial amount of time to complete. However, it may be undesirable to allow the freezer to remain fully operational when a worker is performing these and other common tasks.

The chores described above are often performed with the freezer doors open for extended periods of time. During this time, cold air is released from the freezer compartment and the temperature within the freezer raises, while outside the freezer the temperature drops. The cold air forced through the open doors translates into reduced operating efficiency, increased energy consumption, and higher operating costs. For this reason, workers are often asked to shut down the freezer when performing tasks that require the freezer doors to remain open or when the freezer will otherwise release the cold air into the outside environment.

Workers may also be tempted to temporarily shut down the freezer because the working conditions inside the freezer compartment can be discomforting due to the very cold temperature. In some cases, extended exposure to below-freezing temperature can be detrimental to the health of a worker. Unfortunately, temporarily disabling the freezer (regardless of the reason for doing so) may lead to undesirable or disastrous results.

Although it may be desirable to shut down the freezer for a short period of time during which a specific task is performed, care must be taken to ensure that the freezer is eventually restarted. If a worker forgets to restart the freezer after completing his or her task, then the contents of the freezer may spoil, melt, or be otherwise rendered unmerchantable or inedible. Furthermore, if the freezer remains disabled for a long period of time, then the freezer must eventually work continuously for an undesirably long time before it reaches a suitable below-freezing temperature.

Furthermore, the freezer components may suffer premature wear and tear if the freezer is frequently shut down and restarted. For example, the lifespan of the compressor, which is an integral component in conventional freezers, may be shortened as a result of such treatment.

Freezers typically employ thermostat-actuated solenoid valves that regulate the flow of refrigerant through the various operating components. When power to a freezer is completely shut down, the compressor is disabled and the solenoid valve will automatically close. The closed valve maintains the refrigerant at a relatively high pressure and the compressor is incapable of equalizing the pressure throughout the fluid path. The residual high pressure can be harmful to the compressor when the freezer is restarted because compressors are suitably designed to receive refrigerant at a relatively low pressure.

SUMMARY OF THE INVENTION

Accordingly, it is an advantage of the present invention that an improved apparatus for controlling the operation of a refrigeration system is provided.

Another advantage of the present invention is that the apparatus temporarily shuts down a refrigeration system for a predetermined time period and subsequently restarts the refrigeration system automatically after the time period elapses.

Another advantage is that the apparatus operatively controls the refrigeration system such that only specific components are shut down.

A further advantage of the present invention is that the apparatus temporarily halts the cooling feature of the refrigeration system without disabling the refrigeration system compressor.

Another advantage of the present invention is that operation of the apparatus does not shorten the lifespan of the refrigeration system compressor.

These and other advantages of the present invention are carried out in one form by a control apparatus for use in combination with a refrigeration system having a defrost timer, a solenoid valve, and a thermostat configured to control the solenoid valve. The apparatus includes a relay switch electrically coupled in series between the defrost timer and the thermostat, where the relay switch is configured to provide operating power from the defrost timer to the thermostat when in a closed state, and to electrically disconnect the defrost timer from the thermostat when in an opened state. The apparatus also includes a delay timer electrically connected to the relay switch and configured to provide an energizing signal to the relay switch for a predetermined time period during which the relay switch remains in the opened state. The solenoid valve closes when the relay switch is in the opened state, and it remains closed during the predetermined time period.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

FIG. 3 is a block diagram representation of the control timer;

FIG. 4 is a block diagram representation of an exemplary refrigeration system environment in which the control timer may operate; and FIG. 5 is a table of exemplary operational modes of the refrigeration system.

DETAILED DESCRIPTION OF THE PREFERRED EMBODIMENT

Figure 1:
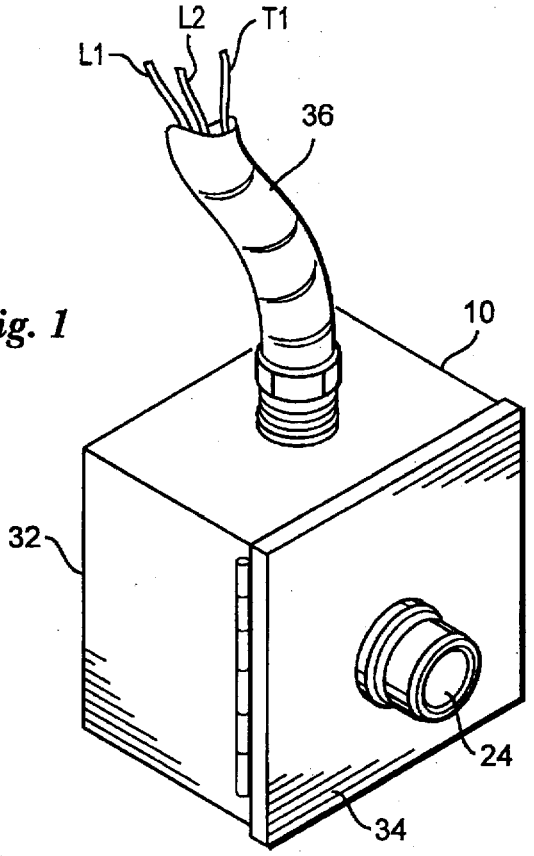
FIG. 1 is a perspective view of a control timer configured in accordance with the present invention.
Figure 2:
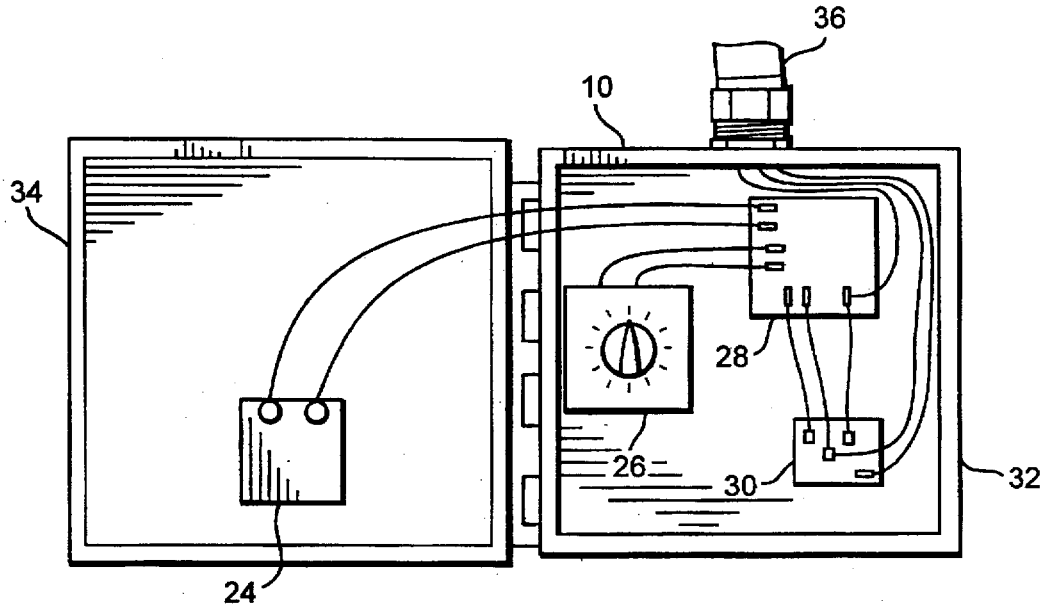
FIG. 2 is a front view of the control timer with the cover opened.

FIGS. 1–2 illustrate various views of a control timer 10 according to the preferred embodiment of the present invention. FIG. 3 is a block diagram representation of control timer 10.

As shown in FIG. 4, control timer 10 may be used to control the operation of a refrigeration system, such as a freezer (not shown), having at least a compressor 12, a defrost heater 14, a defrost timer 16 that operatively controls defrost heater 14, a solenoid valve 18, a thermostat 20 that operatively controls solenoid valve 18, and an evaporator fan 22. Generally, control timer 10 is utilized to disable thermostat 20 and evaporator fan 22 for a predetermined time period while compressor 12 remains operational. Solenoid valve 18 remains closed and defrost heater 14 remains disabled during the predetermined time period.

Referring to FIGS. 1–3, control timer 10 generally includes a start switch 24, a potentiometer 26, a delay timer 28, and a relay switch 30. Those skilled in the art know such parts are or like part numbers 88001 and 87470 (start switch) from Square D Corporation, Madison, Wis., ASY00D1M450 (potentiometer) from National Controls Corp., West Chicago, Ill., Q3F03600325 (delay timer), also from National Controls Corp., and 90295Q (relay switch) from White Rodgers Controls, Murfreesboro, Tenn. The various components are mounted in (or upon) a protective housing 32 having a hinged cover 34. Protective housing 32 is preferably designed to shield the various components from, e.g., dirt, water, and other foreign objects. Start switch 24 is mounted to cover 34 such that an operator can manually engage start switch 24 from the outside of protective housing 32.

A conduit 36 coupled to protective housing 32 routes wires (designated L1, L2, and T1) to various locations within the refrigeration system (see FIG. 4). Those skilled in this art will recognize the familiar designations of the wires carried by conduit 36. Wires L1 and L2 cooperate to form a 220V industrial power circuit. Wire T1 is an "continuation" of L2 that is routed to thermostat 20 and evaporator fan 22. Of course, the various wires may be alternatively routed and/or connected to other refrigeration system components known in the art.

Start switch 24, which is coupled to delay timer 28, is configured to initiate the operation of control timer 10. Start switch 24 is preferably a momentary-contact switch, i.e., start switch 24 remains closed while engaged and releases automatically after engagement. Of course, any suitable device may be employed to initiate the operation of control timer 10, such as an automatic interval timer, a remote control, a keypad, or any number of alternate switch configurations.

Delay timer 28 is configured to provide an energizing signal to relay switch 30 for a time period determined, in part, by the specific resistance of potentiometer 26. Potentiometer 26 is utilized to adjust the length of the predetermined time period during which control timer 10 disables thermostat 20 and evaporator fan 22. Delay timer 28 utilizes the resistance of potentiometer 26 in a conventional timing circuit to provide the energizing signal to relay switch 30 for the associated time period. In the preferred embodiment, potentiometer 26 is capable of adjusting the predetermined time period between two minutes and sixty minutes. Thus, an operator can select the length of time regulated by control timer 10 prior to engaging start switch 24.

The energizing signal produced by delay timer 28 is utilized to actuate relay switch 30. Relay switch 30 may be realized by any number of conventional relay circuit devices. In the preferred embodiment, relay switch 30 is electrically coupled in series between defrost timer 16 and thermostat 20, and also in series between defrost timer 16 and evaporator fan 22 (see FIG. 4). Relay switch 30 has a first terminal 38 electrically coupled to an operating power source provided by defrost timer 16 via wire L2 (see FIGS. 3 and 4). Relay switch 30 has a second terminal 40 electrically coupled to thermostat 20 and to evaporator fan 22. Although relay switch 30 is normally biased in a closed state, the energizing signal from delay timer 28 causes relay switch 30 to open (as shown in FIGS. 3 and 4).

In FIG. 3, wires L1 and L2 are shown coupled to delay timer 28 and relay switch 30. In the preferred embodiment, delay timer 28 and relay switch 30 are active components that require operating power to function properly. Although not necessarily shown in the Figures, other components in control timer 10 and/or the refrigeration system may also require operating power connections to wires L1 and L2.

FIG. 5 is a table of the various operational modes of the refrigeration system. For example, defrost timer 16 may be in an active mode (shown in FIG. 4) in which relay switch 30 receives operating power from defrost timer 16. When defrost timer 16 is in the active mode, defrost heater 14 is disabled. While defrost timer 16 is in the active mode, relay switch 30 is configured to open, in response to the energizing signal provided by delay timer 28, to electrically disconnect the operating power source from thermostat 20 and evaporator fan 22. This state, which is depicted in FIG. 4, is maintained during the predetermined time period.

Conversely, relay switch 30 closes, after the predetermined time period elapses, to electrically connect the operating power source to thermostat 20 and evaporator fan 22. In this normally closed state, control timer 10 allows the refrigerator system to operate in a conventional manner.

In response to the disabling of thermostat 20, solenoid valve 18 also loses power. Consequently, solenoid valve returns to its normally closed position, which prevents passage of refrigerant through solenoid valve 18. Thus, solenoid valve 18 closes when relay switch 30 is in an opened state, and it remains closed during the predetermined time period. However, compressor 12 is capable of pumping down the refrigerant pressure because operating power is maintained at compressor 12 during the predetermined time period. Compressor 12 may incorporate a pressure switch (not shown) for regulating the operation of compressor 12. For example, compressor 12 may automatically shut down when the pressure switch detects a sufficiently high or low refrigerant pressure at corresponding points within the refrigerator system.

In the preferred embodiment, control timer 10 is configured as a "slave" to defrost timer 16. For example, when defrost timer 16 is in a defrost mode, operating power is routed away from relay switch 30 and instead directed to defrost heater 14. Thus, when defrost timer 16 is in the defrost mode, the opened/closed state of relay switch 30 is immaterial. It should be noted that, due to its active nature, relay switch 30 may remain in its normally closed state (regardless of whether start switch 24 is engaged) when defrost timer 16 is in the defrost mode and current is not directed to control timer 10 via wire L2.

In summary, the present invention provides a control timer configured to control the operation of a refrigeration system. The control timer temporarily shuts down the refrigeration system for a predetermined time period and subsequently restarts the refrigeration system automatically after the time period elapses. During the time period, the control timer selectively disables specific components in the refrigeration system to temporarily halt the cooling feature of the refrigeration system without disabling the refrigeration system compressor. In addition, the utilization of the control timer does not shorten the lifespan of the refrigeration system compressor.

The above description is of a preferred embodiment of the present invention, and the invention is not limited to the specific embodiment described and illustrated. For example, the control timer may be adapted for use with various types of refrigeration systems, including freezers and climate control systems. In addition, alternative hardware components may be employed to carry out equivalent functions. Furthermore, many variations and modifications will be evident to those skilled in this art, and such variations and modifications are intended to be included within the spirit and scope of the invention, as expressed in the following claims.

What is claimed is:

1. An apparatus for controlling the operation of a refrigeration system having a defrost heater, a solenoid valve, and a thermostat configured to control said solenoid valve, said apparatus comprising:

a relay switch having a first terminal configured to couple to an operating power source and a second terminal configured to couple to said thermostat; and a delay timer configured to provide an energizing signal to said relay switch for a predetermined time period; wherein said relay switch is configured to open, in response to said energizing signal, to electrically disconnect said operating power source from said thermostat during said predetermined time period;

said relay switch is configured to close, after said predetermined time period elapses, to electrically connect said operating power source to said thermostat;

said solenoid valve closes when said relay switch opens and said solenoid valve remains closed during said predetermined time period; and said defrost heater is disabled during said predetermined time period.

2. An apparatus according to claim 1, further comprising means for adjusting the length of said predetermined time period, said means for adjusting being coupled to said delay timer.

3. An apparatus according to claim 2, wherein said means for adjusting comprises a potentiometer.

4. An apparatus according to claim 1, further comprising means for initiating said predetermined time period, said means for initiating being coupled to said delay timer.

5. An apparatus according to claim 4, wherein said means, for initiating comprises a momentary-contact switch.

6. An apparatus according to claim 1, wherein:

said refrigeration system includes an evaporator fan;

said second terminal of said relay switch is configured to couple to said evaporator fan;

said relay switch is configured to open, in response to said energizing signal, to electrically disconnect said operating power source from said evaporator fan during said predetermined time period; and said relay switch is configured to close, after said predetermined time period elapses, to electrically connect said operating power source to said evaporator fan.

7. An apparatus according to claim 1, wherein:

said first terminal of said relay switch is configured to couple to a defrost timer that operatively controls said defrost heater;

said defrost timer provides operating power to said relay switch when said defrost timer is in a first mode; and said defrost timer removes said operating power from said relay switch and provides said operating power to said defrost heater when said defrost timer is in a second mode.

8. A control apparatus for use in combination with a refrigeration system having a defrost timer, a solenoid valve, and a thermostat configured to control said solenoid valve, said apparatus comprising:

a relay switch electrically coupled in series between said defrost timer and said thermostat, said relay switch being configured to provide operating power from said defrost timer to said thermostat when in a closed state, and to electronically disconnect said defrost timer from said thermostat when in an opened state; and a delay timer electrically connected to said relay switch and configured to provide an energizing signal to said relay switch for a predetermined time period during which said relay switch remains in said opened state; wherein said solenoid valve closes when said relay switch is in said opened state and said solenoid valve remains closed during said predetermined time period.

9. An apparatus according to claim 8, further comprising means for initiating said predetermined time period, said means for initiating being electrically connected to said delay timer.

10. An apparatus according to claim 8, wherein:

said defrost timer operatively controls a defrost heater; and said relay switch receives said operating power from said defrost timer when said defrost heater is disabled.

11. An apparatus according to claim 10, wherein said defrost heater remains disabled during said predetermined time period.

12. An apparatus according to claim 8, wherein:

said refrigeration system includes an evaporator fan;

said relay switch is electrically coupled in series between said defrost timer and said evaporator fan; and said relay switch is configured to provide operating power from said defrost timer to said evaporator fan when in said closed state, and to electrically disconnect said defrost timer from said evaporator fan when in said opened state.

13. An apparatus according to claim 8, further comprising means for regulating the length of said predetermined time period, said means for regulating being electrically connected to said delay timer.

14. A method for controlling the operation of a refrigeration system having a defrost heater, a solenoid valve, and a thermostat configured to control said solenoid valve, said method comprising the steps of:

providing an energizing signal to a relay switch for a predetermined time period, said relay switch having a first terminal configured to couple to an operating power source and a second terminal configured to couple to said thermostat;

opening said relay switch, in response to said energizing signal, to electrically disconnect said operating power source from said thermostat during said time period; and closing said relay switch to electrically connect said operating power source to said thermostat, said closing step being performed after said predetermined time period elapses; wherein said solenoid valve closes in response to said opening step and said solenoid valve remains closed during said predetermined time period; and said defrost heater is disabled during said predetermined time period.

15. A method according to claim 14, wherein:

said refrigeration system includes an evaporator fan;

said second terminal of said relay switch is configured to couple to said evaporator fan;

said opening step electrically disconnects said operating power source from said evaporator fan during said time period; and said closing step electrically connects said operating power source to said evaporator fan after said predetermined time period elapses.

16. A method according to claim 14, wherein:

said refrigeration system includes a compressor; and said method further comprises the step of maintaining operating power to said compressor during said predetermined time period.

17. A method according to claim 14, wherein said defrost heater is operatively controlled by a defrost timer, and wherein said method further comprises the steps of:

providing operating power from said defrost timer to said relay switch when said defrost timer is in a first mode; and removing said operating power from said relay switch and providing said operating power from said defrost timer to said defrost heater when said defrost timer is in a second mode.

18. A method according to claim 14, further comprising the step of adjusting the length of said predetermined time period, said adjusting step occurring prior to said providing step.

* * * * *